United States Patent [19]

Maasberg et al.

[11] 3,984,944

[45] Oct. 12, 1976

[54] DEVICE FOR CLEANING SHIP'S SIDES, TANK WALLS, AND SIMILAR SURFACES

[76] Inventors: Wolfgang Maasberg, Dorfstrasse 14 (Post Drevenack), 421 Krudenburg; Horst Scheiding, Duringer Strasse 4b, 2854 Loxstedt, Bremerhaven, both of Germany

[22] Filed: June 20, 1975

[21] Appl. No.: 588,894

[30] Foreign Application Priority Data

June 21, 1974 Germany ..... 2429838

[52] U.S. Cl. ..... 51/9 M; 118/307; 248/75; 114/222

[51] Int. Cl.[2] ..... B24C 3/06

[58] Field of Search ..... 51/8 R, 8 HD, 9 R, 9 M; 114/222, 223, 224; 118/72, 108, 207, 305, 307; 248/17, 75, 79

[56] References Cited

UNITED STATES PATENTS

| | | | |
|---|---|---|---|
| 3,863,393 | 2/1975 | Goff | 51/9 M |
| 3,900,968 | 8/1975 | Shigyo | 51/9 M X |

FOREIGN PATENTS OR APPLICATIONS

| | | | |
|---|---|---|---|
| 1,224,103 | 9/1966 | Germany | 248/79 |

*Primary Examiner*—Al Lawrence Smith
*Assistant Examiner*—Gary L. Smith
*Attorney, Agent, or Firm*—McGlew and Tuttle

[57] ABSTRACT

A device for cleaning surfaces which extend in a vertical plane and particularly ship's sides, tank walls and similar surfaces which are made of ferromagnetic material, comprises a lifting mechanism which has roller means permitting it to run along a ship's railing or similar structure adjacent the top of the surface to be cleaned. The lifting mechanism includes one or more winding drums or hoists which carry support line means which extend from the lifting mechanism to a carrier for a cleaning apparatus. The cleaning apparatus advantageously includes a housing having an undercarriage which is movable along the surface to be cleaned and which includes magnetic means for causing an attraction between the carrier and the surface to be cleaned so that the carrier is held thereagainst during the cleaning operation. The cleaning apparatus advantageously comprises a cleaning spray beam which extends substantially horizontally and which has one or more spray nozzles along its length for the spraying outwardly of a cleaning agent, such as a liquid, or for applying a sand-blasting action or a cleaning substance against the surface to be cleaned. The support line means advantageously comprises at least a flexible conduit which permits the support of the carrier as well as the transmission of a fluid to the spray which is mounted on the carrier. The flexible conduit is advantageously connected to a high pressure pump for supplying the liquid or similar substance to the carrier at its location along the surface to be cleaned and the hoisting means is effective to move the carrier upwardly and downwardly as the lifting mechanism is advanced along the length of the surface.

10 Claims, 2 Drawing Figures

DEVICE FOR CLEANING SHIP'S SIDES, TANK WALLS, AND SIMILAR SURFACES

FIELD AND BACKGROUND OF THE INVENTION

This invention relates in general to the construction of cleaning devices and, in particular, to a new and useful device for cleaning surfaces of ferromagnetic material such as would be found on ship's sides, tank walls and similar structures, and which includes a carrier which is movable upwardly and downwardly along the surface to be cleaned and carries a spray for spraying a substance against the surface and magnetic means for attracting the carrier to the surface during the cleaning operation.

DESCRIPTION OF THE PRIOR ART

The present invention is particularly applicable to a cleaning device for cleaning ship's sides, tank walls or similar structures which are made of ferromagnetic material. In a known cleaning device of this character, the carrier for the cleaning equipment is provided with a shot-blast apparatus which comprises a jet nozzle. The shot-blast apparatus is used for removing algae deposits on the side of a ship. The cleaning of a ship's side with such a shot-blast apparatus, however, is extremely laborious and time-consuming because the nozzle works only over a relatively small area at a time. Nevertheless, it is necessary to clean relatively large areas of the ship's side regularly if the operation is to be kept within economical limits. With the known equipment, this requires a particularly long period of lay-up of the ship.

SUMMARY OF THE INVENTION

In accordance with the present invention, there is provided a device particularly for cleaning the side surfaces of ships or the tank walls of ships or other surfaces which have ferromagnetic material and in a manner to ensure a completely satisfactory cleaning of large areas without corresponding large costs of labor and ship operation time. In accordance with the invention, a cleaning apparatus includes a carrier having a spray beam which is movable upwardly and downwardly over the surface of a ship or the tank to be cleaned by the operation of hoisting equipment which is connected to the carrier through a flexible tube which also supplies the liquid to the spray. With the inventive arrangement, the carrier is held against the surface to be cleaned by magnetic means which advantageously may be actuated and deactuated in accordance with the cleaning operation, for example, by an electrical control. The magnetic attraction is accomplished by magnets which are sufficient to hold the equipment carrier with the high pressure spray beam at a predetermined distance from the side of the ship or the tank having the surface to be cleaned. The magnets permit the travel or motion of the cleaning equipment carrier over the surface without difficulty but still ensures that the carrier remains in a position closely adjacent the surface being operated upon. The magnetic adhesion which permits motion effect is a surprising effect since the high pressure spray beam is capable of working at pressures of up to 750 bars and more using jets which issue simultaneously from several nozzles along its length. Consequently, considerable reaction forces away from the hull act upon the carrier. In spite of this, however, an uncontrolled action of the high pressure cleaning jets is excluded because the jets remain directed against the side of the ship.

In a preferred embodiment of the invention, the lifting mechanism for the carrier is advantageously contained in a housing which has roller guides which permit it to ride over a support rail structure on the side of the vessel. The housing carries a lifting mechanism winch upon which one or more connecting tubes may be wound or unwound which extend from the lifting mechanism to the carrier containing the cleaning apparatus. With the aid of the lifting mechanism, the equipment carrier which supports a high pressure spray beam can be caused to travel vertically upwardly and downwardly as well as horizontally back and forth with the movement of the lifting mechanism housing along the ship's side and the actuation of the lifting mechanism to raise and lower the carrier. Both the up and down and lateral motion of the carrier with the high pressure spray beam can be continuously adjusted. The vertical reach of the lifting mechanism is adapted to the greatest possible height of the ship's side and, in normal cases, may extend down to the bilge keel and may be selectively limited in its operation to any zone by means of limit switches. This makes it possible, for example, to limit the cleaning operation to above water or underwater surfaces if desired.

The following are substantial features of the invention:

There is provided, in accordance with the invention, a high pressure spray beam which is a replaceable unit which is mounted so as to be suspended from the bottom of the equipment carrier at the ship's side and so that its two ends project to each side of the carrier. The beam is advantageously provided with a plurality of jet nozzles along its length and these may be effective substantially along the entire length of the spray beam.

Also in accordance with the invention, the equipment carrier comprises a watertight housing accommodating electrically driven final-control means for controlling the swing operations of the steerable undercarriages which are provided on the carriers at vertically spaced locations. This permits the cleaning equipment carrier to move in the direction of its longitudinal axis, in parallel to the vertical. The lifting mechanism housing is advantageously provided with an electric drive and a hand-operated portable switch box. This lifting mechanism housing comprises grooved rollers which run on the upper tube of a railing structure along the ship's side and which also includes backing rollers which extend along the surface to be cleaned and which run against the upper part of this surface adjacent the railing. The grooved rollers are mounted in an inclined position corresponding to the force component directed toward the ship's center and permits the mounting of the housing for the lifting mechanism, so that it will be easily maintained on the ship's railing without any possibility that it will be dislodged. The entire unit thus may be easily suspended over the guard rails on the sides of the ship and the device may run along these rails along the length of the ship. The railing tube is constructed so that the grooved rollers can run over the length of the uppermost railing tube and the railing post without obstruction. In some instances, it is advantageous to equip the ship with auxiliary rails to be used for the traveling housing of the lifting mechanism.

The lifting mechanism advantageously includes a two-drum winch which comprises four drum portions for simultaneous actuation of a high pressure flexible tube, an electrical cable, a sandblast flexible tube and, if necessary, an additional suspension rope. The electrical cable leads to the magnets which are on the carrier and which are advantageously designed as electromagnets. In addition, the cable extends to a final control means and the switch gear which is carried in the housing of the equipment carrier. A remote control of the undercarriages of the carrier by means of electric drives is also possible with such an arrangement. The high pressure flexible tube may comprise a tension-relieved portion located between its initial connection to the carrier and its connection to a spray beam on the carrier and this ensures a satisfactory supply of water or other material to the spray beam.

The carrier advantageously is provided with adhesion magnets in the form of electromagnets which are associated with a control device which, at a failure of the current supply, operates into the main contactor of the high pressure pump associated with the system. Thus, upon a failure of the energizing current, the holding contact of the main contactor of the high pressure pump motor will fall off and, thereby, the shot-blasting operation against the ship's side will be instantly interrupted.

Accordingly, it is an object of the invention to provide a cleaning device particularly for use on ship's sides and tank walls which are made of ferromagnetic material and which provides a quick and completely satisfactory means for cleaning large surfaces in a simple and economical manner and with an automatic system which may be operated by a single person and which will permit cleaning of a ship during its operational time.

A further object of the invention is to provide a cleaning device for cleaning surfaces made of a magnetically attractable material which includes a lifting mechanism which is adapted to be positioned in a fixed or movable manner adjacent the top of the surface to be cleaned and which includes a connecting tube which extends from the lifting mechanism to a carrier having a spray beam thereon which is oriented to direct the spray against the surface to be cleaned and which includes an undercarriage for moving the carrier over the surface and which has magnetic means for attracting the carrier to the surface during the operation.

A further object of the invention is to provide a cleaning device which includes a housing containing a lifting mechanism including a winding drum for one or more connecting cables to a cleaning carrier and wherein the housing is movable along the surface and the carrier is movable upwardly and downwardly in respect to the housing and which includes magnetic means on the carrier for attracting it to the surface to be cleaned and for maintaining it in position during the discharge of a material through a spray nozzle on the carrier to the surface.

A further object of the invention is to provide a device for cleaning ship's sides, tank walls, etc., which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference should be had to the accompanying drawing and descriptive matter in which there is illustrated a preferred embodiment of the invention.

DESCRIPTION OF THE PREFERRED EMBODIMENT

Figure 1:
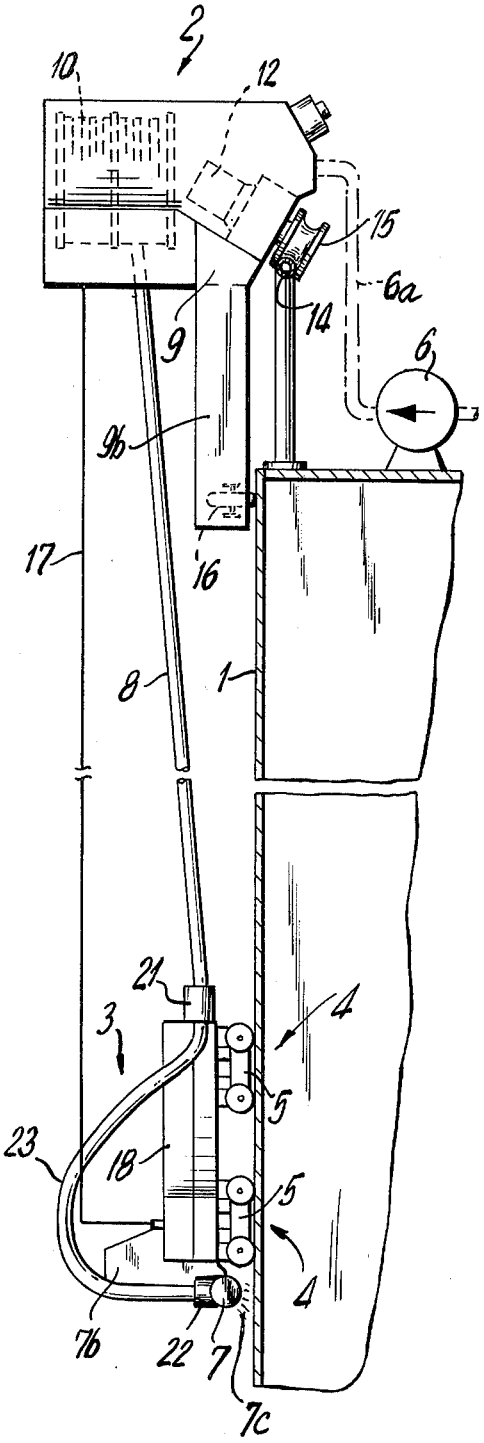
FIG. 1 is a partial lateral elevational view and sectional view of a cleaning device associated with a ship and constructed in accordance with the invention.

Referring to the drawing in particular, the invention embodied therein, comprises a device for cleaning a side surface 1 of a ship or a side surface of a tank or similar structure which is made of a ferromagnetic material. The cleaning device advantageously includes a lifting mechanism 2 in the form of a rotatable drum winch 10 which is mounted in a guard rail crab or housing 9 which is movable along the upper rail 14 of a handrail structure which extends along the side of the ship having the surface to be cleaned.

In accordance with the invention, a cleaning equipment carrier, generally designated 3, is suspended from the lifting mechanism, generally designated 2, by connecting line means which includes one or more connecting lines including an electrical connecting cable 17 and a fluid connecting line or flexible tube 8, and may also include, for example, a flexible line for sandblast material and a suspension rope or similar connecting cable (not shown). In accordance with a feature of the invention, the undercarriage is provided with magnetically attractable means, such as electromagnets 5 which are located between the carrier 3 and the surface 1 to be cleaned and which are preferably associated with separate undercarriages 4, 4 having wheel means for permitting the movement of carrier 3 upwardly and downwardly along surface 1 which is to be cleaned. The magnets 5 act to hold the carrier against the surface during the cleaning operation.

Figure 2:
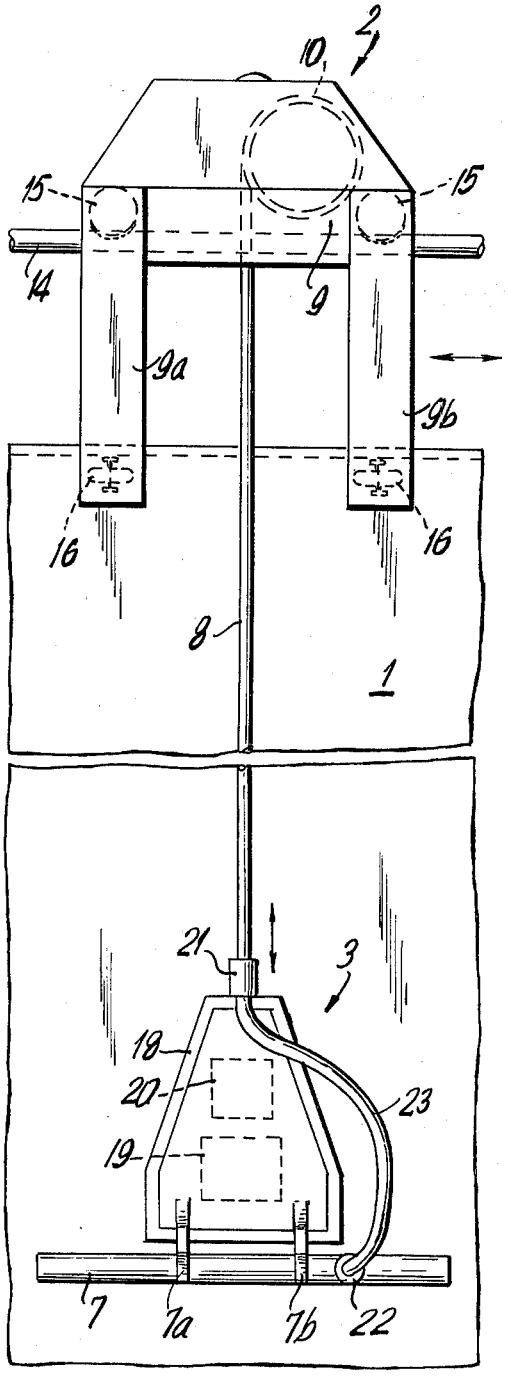
FIG. 2 is a front view of the device shown in FIG. 1.

In accordance with a further feature of the invention, the flexible tube connection means 8 includes means for supplying a cleaning material, such as a liquid, to a spray beam 7 which extends horizontally below the lower end of carrier 3 and is supported by spaced brackets 7*a* and 7*b*, as shown in FIG. 2. Spray bar 7 is provided with a plurality of nozzles along its length which are oriented to direct a spray as at 7*c* inwardly against surface 1 to be cleaned. Spray beam or bar 7 is advantageously replaceably mounted on brackets 7*a* and 7*b* and the spray beam may be removed and replaced by beams of different sizes, etc.

The housing 9 is provided with an electric drive 12 for operating the winch 10 and, for example, for operating rotatable grooved rollers 15, which engage over the upper rail 14 of the guard rail structure of the ship. The housing also includes depending legs 9*a* and 9*b* which carry backing rollers 16 which apply against the upper edge of surface 1 to be cleaned. Grooved rollers 15 are mounted in a position in which they are inclined to bear inwardly against the upper rail 14 so that the entire lifting structure 2 is supported on the rail by rollers 15 and 16 in a manner preventing its withdrawal. Winch 10 of housing 9 is designed as a two-drum winch having four drum portions which permit actuation of the high pressure flexible tube 8, an electric cable 17, a sandblast flexible tube (not shown) and, if necessary, an additional suspension rope (not shown).

The equipment carrier 3 comprises a watertight housing 18 which accommodates electrically driven final-control means 19 for controlling the swing operations of the steerable undercarriages 4, 4 and a switch gear 20. This part of the equipment enables the carrier 3 to move only in the direction of its longitudinal axis, that is, parallel to the vertical. The high pressure flexible tube 8 comprises a tension-relieved portion 23 between its upper connection 21 and its lower connection 22 to the carrier 3 and the spray beam 7, respectively. The adhesion magnets 5 which are preferably electromagnets are associated with a current control device and, at a failure of any current supply, will operate on the main contactors of the high pressure pump 6 which is connected through a connection 6*a* to the upper end of flexible tube 8. A particular aspect of the cleaning device is that it is capable of being used on a ship while the ship is underway.

While a specific embodiment of the invention has been shown and described in detail to illustrate the application of the principles of the invention, it will be understood that the invention may be embodied otherwise without departing from such principles.

What is claimed is:

1. A device for cleaning surfaces, particularly ship's sides, tank walls and similar surfaces made of ferromagnetic material, comprising a lifting mechanism movably mounted adjacent the top of the surface to be cleaned, an equipment carrier suspended from said lifting mechanism, said equipment carrier having an undercarriage movable along the surface to be cleaned upon actuation of said lifting mechanism, magnetic means on said carrier attractable to the surface, said carrier having a cleaning apparatus including a liquid spray beam, and support line means connected between said liquid spray beam and said lifting mechanism and supporting said carrier from said lifting mechanism for delivering a material under pressure to said spray beam for application against the surface to be cleaned.

2. A device for cleaning surfaces, according to claim 1, wherein said support line means comprises a flexible tube, a high pressure liquid pump connected to said flexible tube in the vicinity of said lifting means, said flexible tube comprising a lifting tube associated with said lifting mechanism.

3. A device for cleaning surfaces, according to claim 1, including a guard rail adapted to be located along the length of the surface to be cleaned adjacent the top thereof, said lifting mechanism having a housing guided for movement along said guard rail and including a rotatable winch, said support line means comprising a flexible connecting line windable on said winch.

4. A device for cleaning surfaces, according to claim 3, wherein said spray beam comprises an elongated tubular member and means for suspending said tubular member on said carrier so as to extend outwardly from each side thereof.

5. A device for cleaning surfaces, according to claim 1, wherein said equipment carrier includes a watertight housing, electrical control means in said watertight housing, said carrier having at least one undercarriage with rollers engageable on said surface and being driven by said electrical control means.

6. A device for cleaning surfaces, according to claim 1, wherein said lifting means includes a housing having a winch therein, and including a guide rail defined along the top of the surface to be cleaned, said housing having roller means engageable on said guide rail for moving said housing along said guide rail and drive means in said housing for driving said rollers to move said housing along said guide rail.

7. A device for cleaning surfaces, according to claim 6, wherein said roller means includes a set of grooved rollers on said housing engageable on the top of said guard rail, said housing having at least one depending portion with a backing roller engaged along the surface to be cleaned, said grooved rollers being mounted to engage against said guard rail obliquely on the side thereof opposite to said backing rollers.

8. A device for cleaning surfaces, according to claim 1, wherein said lifting means comprises a rotatable winch, said winch comprising two separate drums, said connecting means comprising a separate connecting member between said carrier and a respective one of said drums which are windable on said drums and includes a flexible high pressure tube, an electrical cable, and a sandblast supply tube.

9. A device for cleaning surfaces, according to claim 1, wherein said support line means comprises a flexible tube extending between said carrier and said lifting means and having a tension-relieved portion extending between the connection of said tube to said carrier and said tube to said spray beam.

10. A device for cleaning surfaces, according to claim 1, wherein said magnetic means comprises electromagnets and a control for energizing and de-energizing said electromagnets.

* * * * *